US006302794B1

(12) United States Patent
Ogawa

(10) Patent No.: US 6,302,794 B1
(45) Date of Patent: Oct. 16, 2001

(54) GAME MACHINE WITH CONCENTRATIVE PRIZE MODE

(75) Inventor: Masaki Ogawa, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/258,808

(22) Filed: Feb. 26, 1999

(30) Foreign Application Priority Data

Feb. 27, 1998 (JP) ..... 10-064820

(51) Int. Cl.[7] ..... A63F 9/24

(52) U.S. Cl. ..... 463/25; 463/16; 463/20; 463/12; 463/13

(58) Field of Search ..... 463/16–20, 21, 463/22, 25, 26, 27, 12, 13; 273/138.1, 138.2, 143 R, 148 B, 121 B, FOR 138 A, FOR 143 R

(56) References Cited

U.S. PATENT DOCUMENTS 4,679,143 7/1987 Hagiwara .
4,844,464 7/1989 Berge .
4,991,848 2/1991 Greenwood et al. .
5,123,649 * 6/1992 Tiberio ..... 273/143 R
5,380,008 1/1995 Mathis et al. .
5,393,061 * 2/1995 Manship et al. ..... 273/143 R
5,645,486 * 7/1997 Nagao et al. ..... 463/27
5,989,121 * 11/1999 Sakamoto ..... 463/20

FOREIGN PATENT DOCUMENTS 7-112051 5/1995 (JP) .
8-280872 10/1996 (JP) .

OTHER PUBLICATIONS

EPO Search Report, re: EP99 30 1384, dated Dec. 20, 2000.

* cited by examiner

*Primary Examiner*—Michael O'Neill
(74) *Attorney, Agent, or Firm*—Pillsbury Winthrop LLP

(57) ABSTRACT

A game machine capable of providing proper expected values.

The game machine is provided with a prize decision table to be applied to a game in an ordinary probability game state and a prize decision table to be applied to a game in a high probability game state. The former and latter prize decision tables are stored with at least data of numbers of lottery random numbers for providing basis of the individual lottery probabilities for individual prize modes. By increasing the number of lottery random numbers for a predetermined mode in the high probability game state but by decreasing the number of lottery random numbers for another mode, the prize probability of the predetermined mode is enhanced, and an expected value to be obtained in the high probability game state is set to a proper expected value or less.

10 Claims, 15 Drawing Sheets

Prize Decision Table in Ordinary Probability Game State

| | Prize Mode | | | | | |
|---|---|---|---|---|---|---|
| | B・B | R・B | S・B | Replay | Bell | Bullet |
| Lottery Probability | 13/16384 | 70/16384 | 712/16384 | 2245/16384 | 819/16384 | 5/16384 |
| No. of Lottery RN | 13 | 70 | 712 | 2245 | 819 | 5 |
| Total of RN | 16384 | 16384 | 16384 | 16384 | 16384 | 16384 |
| Bonus Coin No. | 15 | 15 | 4 | 3 | 10 | 2 |
| Expected Value | 0.00397 | 0.02136 | 0.057943 | 0.13702 | 0.16663 | 0.00041 |

(Total of Expected Values RT=0.38733)

Prize Decision Table in High Probability Game State

| | Prize Mode | | | | | |
|---|---|---|---|---|---|---|
| | B・B | R・B | S・B | Replay | Bell | Bullet |
| Lottery Probability | 13/16384 | 70/16384 | 7120/16384 | 2245/16384 | 720/16384 | 5/16384 |
| No. of Lottery RN | 13 | 70 | 7120 | 2245 | 720 | 5 |
| Total of RN | 16384 | 16384 | 16384 | 16384 | 16384 | 16384 |
| Bonus Coin No. | 15 | 15 | 4 | 3 | 10 | 2 |
| Expected Value | 0.00397 | 0.02136 | 0.57943 | 0.13702 | 0.14648 | 0.00041 |

(Total of Expected Values RT=0.88867)

Fig.1A

Prize Decision Table in Ordinary Probability Game State

| | Prize Mode | | | | | |
|---|---|---|---|---|---|---|
| | B・B | R・B | S・B | Replay | Bell | Bullet |
| Lottery Probability | $a_1$ | $a_2$ | $a_3$ | $a_4$ | $a_5$ | $a_6$ |
| Bonus Coin No. | $M_1$ | $M_2$ | $M_3$ | $M_4$ | $M_5$ | $M_6$ |

$$RL = \{ (a_1 \times M_1) + (a_2 \times M_2) + (a_3 \times M_3) + (a_4 \times M_4) + (a_5 \times M_5) + (a_6 \times M_6) \} \div T$$

Fig.1B

Prize Decision Table in High Probability Game State

| | Prize Mode | | | | | |
|---|---|---|---|---|---|---|
| | B・B | R・B | S・B | Replay | Bell | Bullet |
| Lottery Probability | $a_1$ | $a_2$ | $A_3$ | $a_4$ | $a_5$ | $a_6$ |
| Bonus Coin No. | $M_1$ | $M_2$ | $M_3$ | $M_4$ | $M_5$ | $M_6$ |

$$RH = \{ (a_1 \times M_1) + (a_2 \times M_2) + (A_3 \times M_3) + (a_4 \times M_4) + (a_5 \times M_5) + (a_6 \times M_6) \} \div T$$

(Here $A_3 = 10 \times a_3$)

Fig. 6A

Prize Decision Table

| | Prize Mode | | | | | |
|---|---|---|---|---|---|---|
| | B・B | R・B | S・B | Replay | Bell | Bullet |
| Lottery Probability | $a_1$ | $a_2$ | $a_3$ | $a_4$ | $a_5$ | $a_6$ |
| No. of Lottery RN | $r_1$ | $r_2$ | $r_3$ | $r_4$ | $r_5$ | $r_6$ |
| Total of RN | RDM | RDM | RDM | RDM | RDM | RDM |
| Bonus Coin No. | $M_1$ | $M_2$ | $M_3$ | $M_4$ | $M_5$ | $M_6$ |
| Expected Value | $R_1$ | $R_2$ | $R_3$ | $R_4$ | $R_5$ | $R_6$ |

(Total of Expected Values $RT=R1+R2+R3+R4+R5+R6$)

Fig.6B

Prize Decision Table in Ordinary Probability Game State

| | Prize Mode | | | | | |
|---|---|---|---|---|---|---|
| | B・B | R・B | S・B | Replay | Bell | Bullet |
| Lottery Probability | 13/16384 | 70/16384 | 712/16384 | 2245/16384 | 819/16384 | 5/16384 |
| No. of Lottery RN | 13 | 70 | 712 | 2245 | 819 | 5 |
| Total of RN | 16384 | 16384 | 16384 | 16384 | 16384 | 16384 |
| Bonus Coin No. | 15 | 15 | 4 | 3 | 10 | 2 |
| Expected Value | 0.00397 | 0.02136 | 0.057943 | 0.13702 | 0.16663 | 0.00041 |

(Total of Expected Values $RT=0.38733$)

Fig. 6C

Prize Decision Table in High Probability Game State

| | Prize Mode | | | | | |
|---|---|---|---|---|---|---|
| | B・B | R・B | S・B | Replay | Bell | Bullet |
| Lottery Probability | 13/16384 | 70/16384 | 7120/16384 | 2245/16384 | 720/16384 | 5/16384 |
| No. of Lottery RN | 13 | 70 | 7120 | 2245 | 720 | 5 |
| Total of RN | 16384 | 16384 | 16384 | 16384 | 16384 | 16384 |
| Bonus Coin No. | 15 | 15 | 4 | 3 | 10 | 2 |
| Expected Value | 0.00397 | 0.02136 | 0.57943 | 0.13702 | 0.14648 | 0.00041 |

(Total of Expected Values $RT=0.88867$)

| | |
|---|---|
| (A) | BB Game |
| (B) | RB Game |
| (C) | SB Game |
| (D) | Replay |
| (E) | Bell |
| (F) | Bullet |

GAME MACHINE WITH CONCENTRATIVE PRIZE MODE

This patent application claims priority based on the Japanese patent application, H10-64820 filed on Feb. 27, 1998 the contents of which are incorporated herein by reference.

BACKGROUND OF THE INVENTION

1. Field of the Invention

The present invention relates to a game machine having a variety of prize modes and, more particularly, to a game machine having a function to make a change to a game state, in which a predetermined prize mode is easily concentrated, when a predetermined condition is satisfied.

2. Related Art

Conventionally, the game machine equipped with such various prize modes is prepared to have a plurality of prize modes of low bonuses (as will be called the "low bonus modes") and a plurality of prize modes of high bonuses (as will be called the "high bonus modes") so that any of these low bonus modes and high bonus modes may be selected by a random number lottery.

For each prize mode, on the other hand, the lottery probabilities and the bonus numbers are predetermined according to the bet numbers so that the game can be played within a range of the expected value which is determined by those bet number, lottery probability and bonus number. Here, the expected value indicates how many coins can be expected for each coin inserted for a game.

There are further prepared a game state set to a relatively low expected value $R_L$ (as will be called the "ordinary probability game state") and a game state set to a higher expected value $R_H$ than that of the ordinary probability game state (as will be called the "high probability game state"). If a predetermined condition is satisfied during in a play in the ordinary probability game state, the game state is changed to the high probability game state so that a predetermined prize mode is concentratively prized to give the high expected value $R_H$ to the player.

For example, the conventional slot machine is prepared to have the prize modes which are called a big bonus game (as will be called the "BB game"), a regular bonus game (as will be called the "RB game") and a single bonus game (as will be called "SB game") as the high bonus modes, and a small mode such as "Replay", "Bell" or "Bullet" as the low bonus modes.

On the other hand, there are prepared a prize decision table for the ordinary probability game state, which is stored with data of lottery probabilities $a_1$ to $a_6$ and bonus coin numbers $M_1$ to $M_6$ assigned to the respective prize modes, as shown in FIG. 1A, and a prize decision table for the high probability game state, which is stored with data of the lottery probabilities $a_1$, $a_2$, $a_3$, $a_4$ to $a_6$ and the bonus coin numbers $M_1$ to $M_6$ assigned to the respective prize modes, as shown in FIG. 1B. The expected value $R_L$ in the ordinary probability game state and the expected value $R_H$ in the high probability game state are determined on the basis of the following Formulas (1) and (2):

$$R_L=\{(a_1\times M_1)+(a_2\times M_2)+(a_3\times M_3)+(a_4\times M_4)+(a_5\times M_5)+(a_6\times M_6)\}\div T \quad (1);$$

and $$R_H=\{(a_1\times M_1)+(a_2\times M_2)+(a_3\times M_3)+(a_4\times M_4)+(a_5\times M_5)+(a_6\times M_6)\}\div T \quad (2);$$

Here in Formulas (1) and (2): T indicates the bet number; $a_1$ to $a_6$ and $A_3$ indicate the lottery probabilities for the respective prize modes; and $M_1$ to $M_6$ indicate the bonus coin numbers for the respective prize modes. For the "SB game", on the other hand, the lottery probability $a_3$ in the ordinary probability game state and the lottery probability $A_3$ in the high probability game state are set in a relation of $A_3=10\times a_3$, from which the expected values $R_L$ and $R_H$ are related to $R_L<R_H$.

During a game in the ordinary probability game state, the random number lottery for a prize mode is performed on the basis of the prize decision table shown in FIG. 1A.

If a predetermined condition is satisfied during a game in the ordinary probability game state, on the other hand, the high probability game state is established by making a change to the prize decision table, as shown in FIG. 1B. As a result, the probability, at which the "SB game" is randomly lotted, i.e., the lottery probability is raised from a3 to $A_3$ ($=10\times a_3$) so that the "SB game" is concentratively won to provide a game of the high expected value $R_H$ for the player.

In the conventional game machine thus far described, the expected value $R_H$ in the high probability game state is enhanced by raising only the lottery probability for a specific prize mode such as the aforementioned "SB game" when the game state is switched from the ordinary probability one to the high probability one. In the respective prize decision tables shown in FIGS. 1A and 1B, more specifically, the expected value is enhanced from $R_L$ to $R_H$ merely by raising the lottery probability for the "SB game" from $a_3$ to $A_3$.

If the expected values $R_L$ and $R_H$ are set by those means, however, the expected value $R_H$ in the high probability game state may exceed a predetermined proper expected value Rmax (e.g., 0.9) to raise the so-called "payout ratio" so excessively that no proper game mode cannot be provided for the player thereby to impose a heavy economical burden on the game house.

SUMMARY OF THE INVENTION

The invention has been conceived to solve the aforementioned problems of the related art and has an object to provide a game machine which is provided with prize decision tables capable of setting proper expected values for an ordinary probability game state and a high probability game state.

In order to achieve this object, according to the invention, a game machine having a plurality of prize modes and adapted to be transferred, when a predetermined condition is satisfied, from an ordinary game state to a high probability game state in which the prize probability of a predetermined one of the plurality of prize modes is enhanced, wherein the prize probability of at least one other than the predetermined prize mode in the high probability game state is set lower than the prize probability in the ordinary game state.

There is further provided a game machine, wherein the plurality of prize modes are lotted by a random sampling so that the prize probability of a predetermined prize mode in the high probability game state is enhanced by increasing the number of the lottery random numbers for the predetermined prize mode whereas the prize probability of the one other than the predetermined prize mode in the high probability game state is lessened by reducing the number of the lottery random numbers for the one other than the predetermined prize mode.

With this construction, the expected value in the high probability game state is set by raising the prize probability of a specific prize mode and by lowering the prize probability of another prize mode. As a result, it is possible to set a more proper expected value within a range at or lower than a predetermined proper expected value than to set the expected value in the high probability game state by enhancing only the prize probability for the specific prize mode. As a result, the problem that the so-called "payout ratio" becomes excessively high can be avoided in advance to provide a proper game mode for a player and to realize a game machine which will impose no economical burden on the game house or the like.

BRIEF DESCRIPTION OF THE DRAWINGS

FIGS. 1A and 1B are diagrams conceptionally showing construction of prize decision tables belonging to a conventional game machine;

FIGS. 6A, 6B and 6C are diagrams conceptionally showing the constructions of prize decision tables belonging to the slot machine shown in FIG. 2;

DESCRIPTION OF THE PREFERRED EMBODIMENTS

Figure 2:
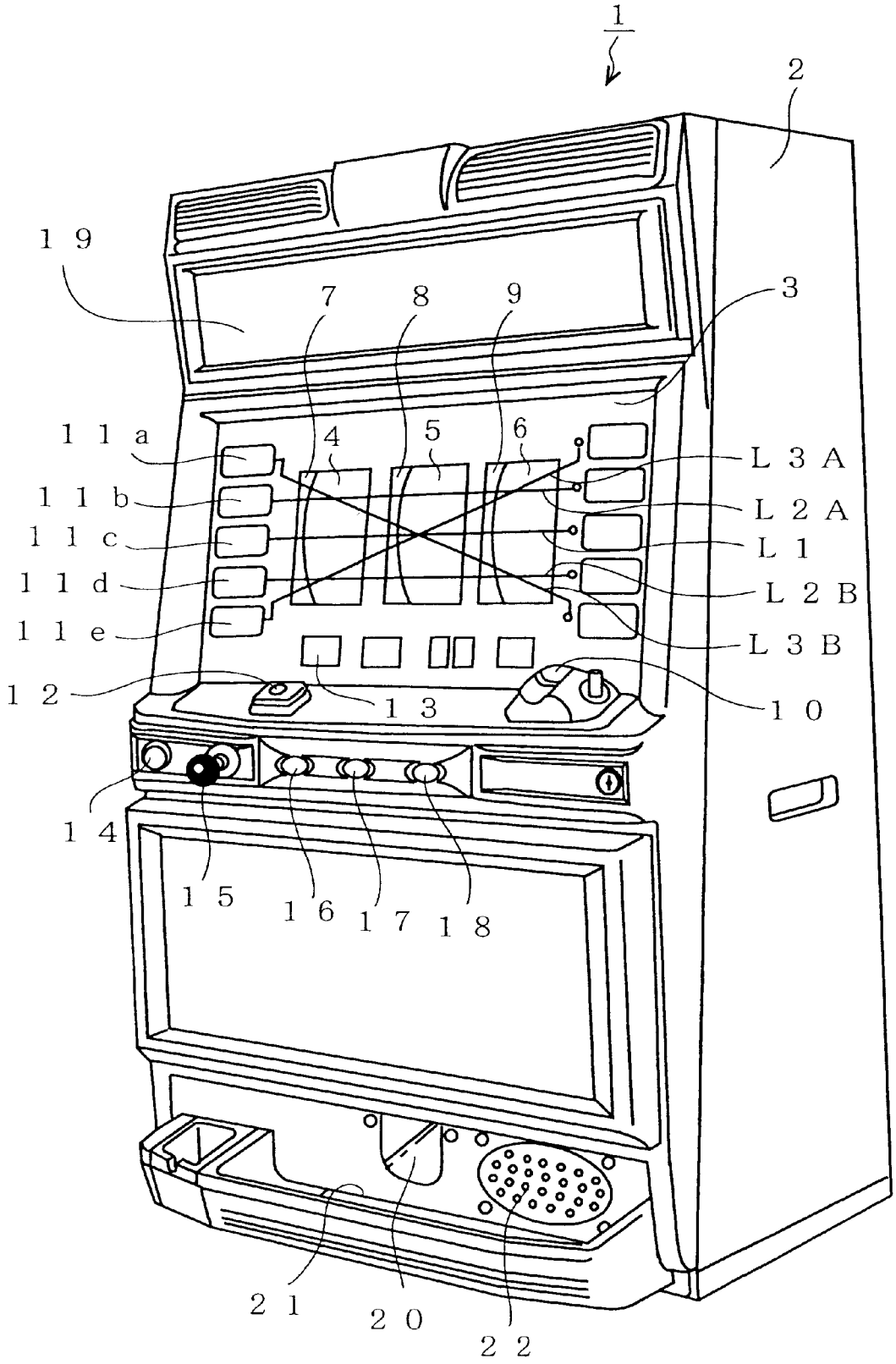
FIG. 2 is a perspective view showing an external structure of a slot machine according to an embodiment of the invention.

Here will be described an embodiment in which a game machine of the invention is applied to a slot machine 1. FIG. 2 presents a perspective view, as taken obliquely from the front, of a slot machine 1 according to this embodiment.

In FIG. 2, the slot machine 1 is provided at its casing 2 with a front panel 3 facing the player. At the back of this front panel 3, there are rotatably mounted three reels 4, 5 and 6 which construct variable display means. On the outer circumference of each of the reels 4, 5 and 6, there is illustrated a symbol column which is composed of a plurality of patterns (as will be called the "symbols"). Three of these symbols are observed through display windows 7, 8 and 9 which are opened in the front face of the front panel 3.

Below the display windows 7, 8 and 9, there are individually: a slot 10 for the player to insert three or less game coins for each game; a bet switch 12 for betting three or less game coins within a range of the credit balance without inserting the game coins into the slot 10; and a credit number display unit 13 composed of seven-segment LEDs or the like for displaying the credit balance.

In the display windows 7, 8 and 9, there are illustrated three horizontal winning lines L1, L2A and L2B and two oblique winning lines L3A and L3B. On the lefthand side of the display window 7, there are provided five effective line display lamps 11*a* to 11*e* corresponding to the individual winning lines L1, L2A, L2B, L3A and L3B.

Figure 3A:
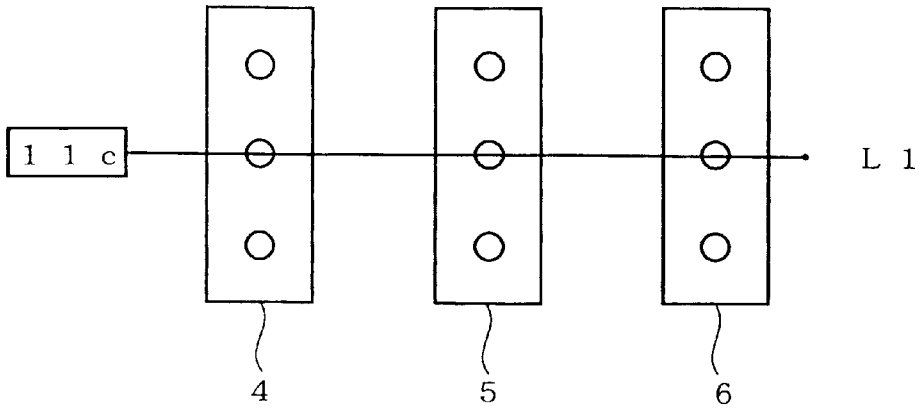
FIGS. 3A, 3B and 3C are diagrams showing states in which prize lines illustrated in the display window of the slot machine shown in FIG. 2 are sequentially effected.
Figure 3B:
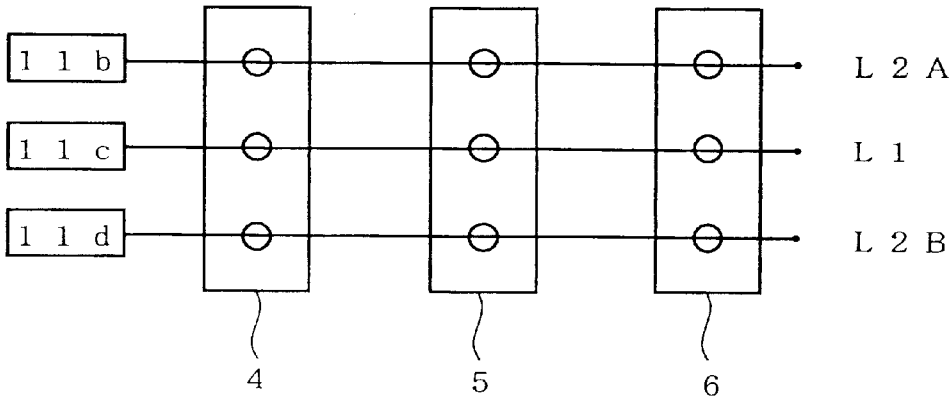
Figure 3C:
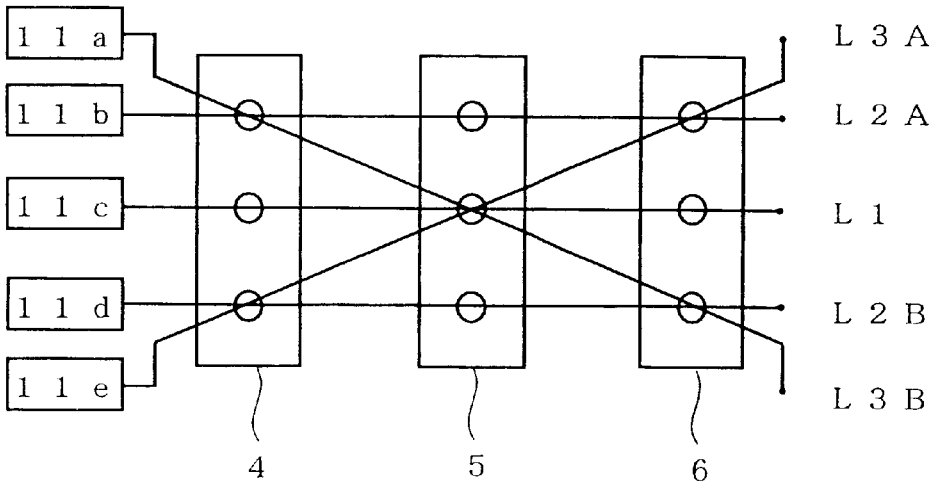

When the player inserts one game coin into the slot 10 or depresses the bet switch 12 one time prior to the start of each game, the bet number is "1". As shown in FIG. 3A, the center winning line L1 is then exclusively effected, and the effective line display lamp 11*c* is lighted. When the player inserts two game coins into the slot 10 or depresses the bet switch 12 two times, the bet number is "2". Then, all of the three horizontal winning lines L1, L2A and L2B are effected, as shown in FIG. 3B, and the effective line display lamps 11*b*, 11*c* and 11*d* are lighted. When the player inserts three game coins or depresses the bet switch 12 three times, the bet number is "3". Then, all of the five horizontal and oblique winning lines L1, L2A, L2B, L3A and L3B are effected, as shown in FIG. 3C, and all the effective line display lamps 11*a* to 11*e* are lighted.

Below the bet switch 12, there are disposed: a credit/payout switch (as will be shortly referred to as the C/P switch) 14 for switching the credit and payout of the game coins, as acquired by the player, in response to the depression of the player; a game start lever 15 for turning the reels 4, 5 and 6 altogether in response to the tiling operation of the player; and three stop button switches 16, 17 and 18 arranged to correspond to the respective reels 4, 5 and 6 for stopping the reels 4, 5 and 6, respectively, in response to the depressions of the player.

In the upper portion of the front face of the casing 2, there is disposed a prize display unit 19 for displaying combination tables enumerating the kinds of symbol combinations of prize modes and the numbers or the like of game coins to be paid back in response to the individual prize modes. In the lower portion of the front face of the casing 2, there are disposed a coin payout tray 21 for reserving the game coins, as paid out through a coin payout chute 20, and a speaker mouth 22 for outputting the various effect sounds, as emitted from a speaker in the casing 2, to the outside.

Figure 4:
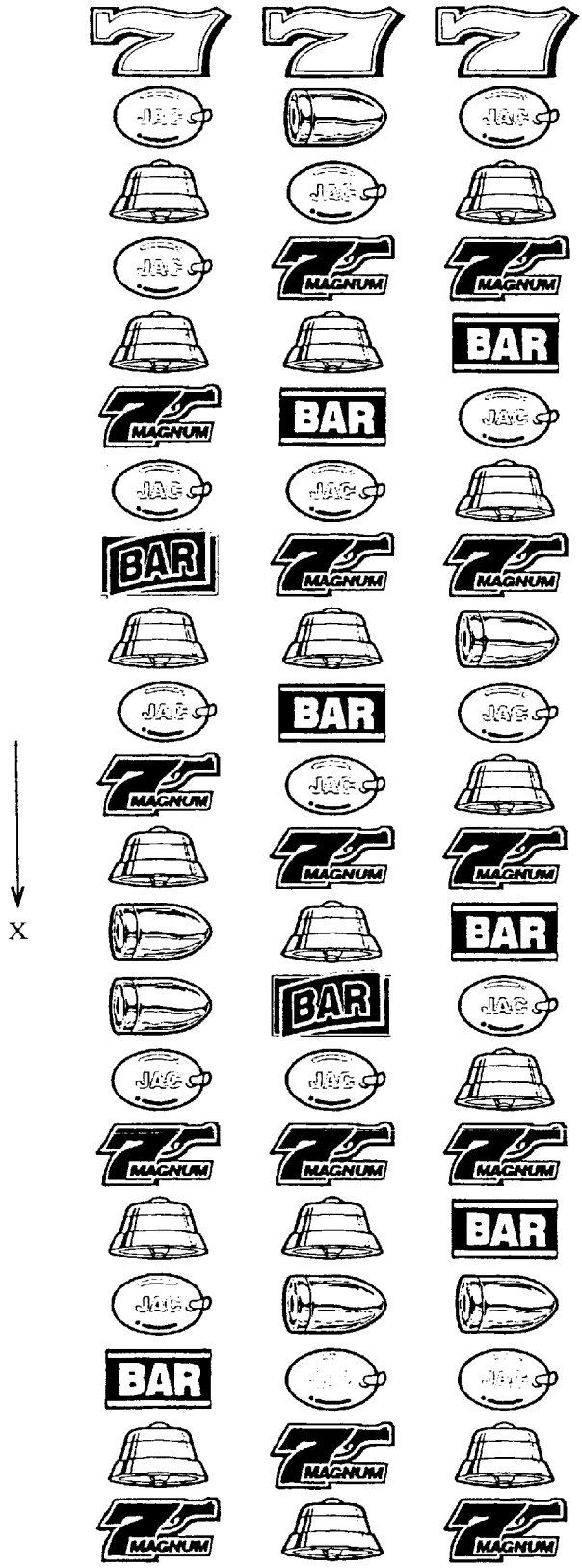
FIG. 4 is an explanatory diagram showing symbols which are illustrated on the reels of the slot machine shown in FIG. 2.

Each of the symbol columns, as illustrated in the reels 4, 5 and 6, is composed twenty one symbols, as shown in an exploded view of FIG. 4. As the individual reels 4, 5 and 6 rotate in the direction of arrow X, those symbols reciprocally move in the same direction.

Here, each of the aforementioned symbol columns having twenty one symbols is composed of totally seven kinds of symbols: patterns of the numeral "7", as called the "Seven"; patterns bearing letters "JAC" on plums, as called the "JAC"; patterns of a bell, as called the "Bell"; patterns bearing letters "MAGNUM", as called the "magnum"; patterns of a bullet, as called the "Bullet"; and patterns of two kinds of white and black letters "BAR", as called the "Bar".

When the reels 4, 5 and 6 are stopped in response of the depressions of the stop button switches 16, 17 and 18 by the player, moreover, the prize of the mode, as lotted at random, is determined if the combination of the symbols arrayed on any of the effected winning lines L1, L2A, L2B, L3A and L3B coincides with the combination of the symbols of the prize mode.

Figure 5:
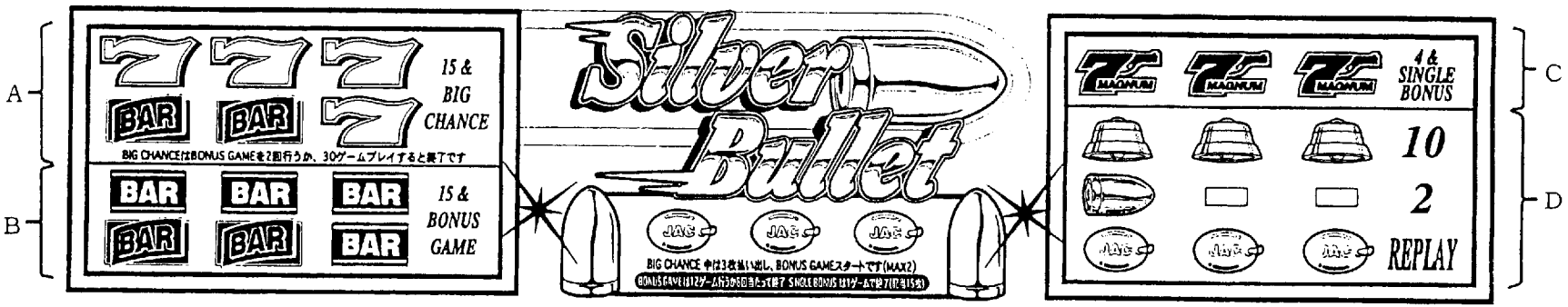
FIG. 5 is a diagram showing a symbol combination table which is illustrated in the prize display unit of the slot machine shown in FIG. 2.

FIG. 5 shows the content of the symbol combination table which is illustrated in the prize display unit 19. In this combination table, the symbol combinations, as appearing in a lefthand upper column A, a lefthand lower column B and a righthand upper column C, illustrate the kinds of high bonus modes, as called the "bonus mode", and the symbol combinations, as appearing in a righthand lower column D, illustrate the kinds of low bonus mode, as called "small mode".

Specifically, when the three symbols on the aforementioned effect winning line are all the "Seven", as illustrated in the lefthand upper column A, or when the two symbols are the "Bar" and the one symbol is the "Seven", fifteen game coins are paid back, and the "BB" game is then performed. When the three symbols on the effective winning line are all the "Bar", as illustrated in the lefthand lower column B of the same table, fifteen game coins are paid back, and the "RB" game is then performed. When the three symbols on the effective winning line are all the "Magnum", on the other hand, as illustrated in the righthand upper column C of the same table, four game coins are paid back, and the "SB" game is then performed. When the three symbols on the effective winning line are all the "Bell", as illustrated in the righthand lower column D of the same table, moreover, ten game coins are paid back; when the lefthand one of three symbols is the "Bullet", two game coins are paid back; and when three symbols are all the "JAC", another game (or replay) is offered.

The probabilities for these prize modes to occur are stored in advance as the data in the prize decision table which is referred to for the random sampling, as will be described hereinafter. As shown in FIG. 6A, more specifically, the prize decision table is constructed to have the individual data of Lottery Probability, No. of Lottery Random Numbers, Total of Random Numbers, Bonus Coin No. and Expected Value and so on for each prize mode.

Here, the "Total of Random Numbers" is the total RDM of the random numbers which are generated by a random sampling for lotting a prize mode. In this embodiment, RDM=16384 because the random numbers are generated within a range of 0 to 16383.

The "No. of Lottery Random Numbers" is the number of random numbers which are present in the range assigned to each prize mode by assigning a random number in the range of 0 to 16383 to a specific range for each prize mode. Specific numbers $r_1$ to $r_6$ are set for the individual prize modes.

The "Lottery Probability" is expressed by the ratios of the numbers of lottery random numbers $r_1$ to $r_6$ to the total RDM of random numbers for each prize mode and is represented by $a_1=r_1/RDM$ for the "BB game".

The "Bonus Coin No." is expressed by the numbers $M_1$ to $M_6$ of coins to be paid back for the individual prize modes and is determined for each prize mode.

The "Expected Value" is determined for each prize mode on the basis of the following Formula (3). Here in Formula (3), the symbol combination number is the total of combinations, which can be made of the above-specified seven kinds of symbols, such as 9261 together with a reeling number:

$$R_i=(\text{No. of Lottery RN})/(\text{Total of RN})\times(\text{Bonus Coin Numbers})\times 1/(\text{Bet No.})\times(\text{Reeling No.})/(\text{Symbol Combination No.})=r_1/RDM\times M_1\times 1/3\times 9261/9261 \quad (3);$$

wherein RN: the random numbers.

Moreover, the total (or expected value total) $R_T$ of expected values $R_i$ (wherein letter i indicates the No. of each prize mode) of the individual prize modes is no more than the proper expected value (e.g., 0.9) which is determined advance for each game state, as expressed by the following Formula (4):

$$R_T=\sum_{i=1}^{6} Ri \le Rmax. \quad (4)$$

Moreover, the prize decision table, as shown in FIG. 6A, is also provided for the ordinary probability game and the high probability game.

More specifically, the prize decision table to be used in the ordinary probability game is composed of the numerical data, as shown in FIG. 6B, and the total expected value $R_T$ is set at 0.38733. On the other hand, the prize decision table to be used in the high probability game is constructed of the numerical data, as shown in FIG. 6C, and the total expected value $R_T$ is set at 0.88867.

In FIG. 6C, the number of lottery random numbers for the "SB game" is 7120, which is ten times as high as the number of 712 in the prize decision table shown in FIG. 6B. For the "SB game", therefore, the lottery probability and the expected value are ten times as high as those for the "SB game" in the prize decision table shown in FIG. 6B, so that the probability for the "SB game" to be lotted is raised to ten times by the random sampling, as will be described hereinafter.

If the number of lottery random numbers for the "SB game" were merely raised to ten times, the total expected value $R_T$ would exceed the proper expected value Rmax. By lowering the number of the lottery random numbers for the "Bell" or the low bonus mode from 819 to 720, therefore, the total expected -value $R_T$ of the prize decision table, as shown in FIG. 6C, is adjusted to 0.88867 no more than the proper expected value Rmax.

Figure 7:
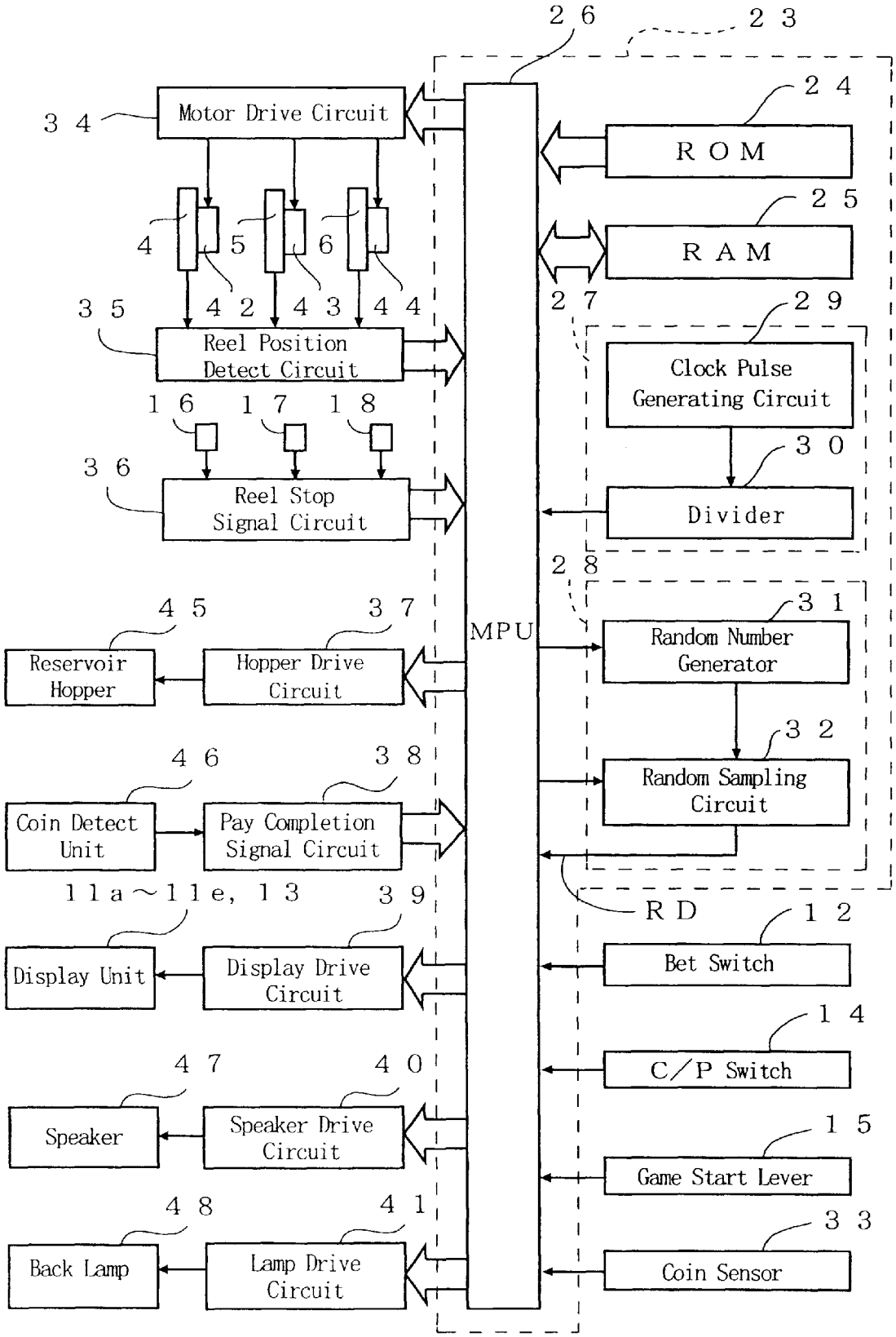
FIG. 7 is a block diagram showing the constructions of a control unit for controlling the operations of the slot machine shown in FIG. 2 and peripheral units.

FIG. 7 shows a circuit construction including a control unit 23 for controlling the game processing operations in the slot machine 1, and peripheral devices electrically connected with the control unit 23.

As shown in FIG. 7, the control unit 23 is constructed to include: a microprocessor (MPU) 26 provided with a read only memory (ROM) 24 and a random access memory (RAM) 25; a clock circuit 27 for generating an operation clock signal of the MPU 26; and a random number setting unit 28 for setting a random number to be sampled.

The ROM 24 is stored with not only a game processing procedure to be executed in the slot machine 1 as a sequence program but also prize decision tables or the like for the ordinary probability game and the high probability game, as shown in FIGS. 6B and 6C. The RAM 25 is provided with a storage region for storing the various processing data or flag data when the MPU 26 processes according to the aforementioned sequence program.

The clock circuit 27 is constructed to include a clock pulse generating circuit 29 for generating a reference clock signal of a predetermined frequency, and a divider 30 for generating a clock signal for operating the MPU 26 by dividing the frequency of the reference clock signal.

The random number setting unit 28 is constructed to include a random number generator 31 for generating a random number within a predetermined range (e.g., 0 to 16383) in response to a command of the MPU 26, and a random sampling circuit 32 for sampling an arbitrary random number RD from the random numbers generated by the random number generator 31, and transferring the sampled random number RD to the MPU 26.

With a plurality of input/output ports (or I/O ports) of the MPU 26, there are connected: the bet switch 12; the C/P switch 14; the game start lever 15; the coin sensor 33 for detecting the game coin inserted into the slot 10; a motor drive circuit 34; areel position detect circuit 35; areel stop signal circuit 36; a hopper drive circuit 37; a pay completion signal generating circuit 38; a display drive circuit 39; a speaker drive circuit 40; and a lamp drive circuit 41.

With the motor drive circuit 34, there are connected stepping motors 42, 43 and 44 for driving the reels 4, 5 and 6 rotationally. The stop button switches 16, 17 and 18 are connected with the reel stop signal circuit 36. When the player tilts the game start lever 15, the MPU 26 detects this tilt to cause the motor drive circuit 34 to start feed drive pulses to the stepping motors 42, 43 and 44 thereby to rotate the reels 4, 5 and 6. When the stop button switches 16, 17 and 18 are depressed, on the other hand, the reel stop signal circuit 36 detects the depressions and transfers its detect signal to the MPU 26. In response to this detect signal, moreover, the MPU 26 causes the motor drive circuit 34 to stop the feed of the drive pulses to the stepping motors 42, 43 and 44 thereby to stop the reels 4, 5 and 6.

The reel position detect circuit 35 is provided with an optical sensor or the like for detecting the rotational positions (or rotational angles) of the reels 4, 5 and 6, so that the position detect signals detected by the optical sensor or the like are transferred to the MPU 26 to inform the positional data of the individual symbols illustrated on the reels 4, 5 and 6.

With the hopper drive circuit 37, there is connected a reservoir hopper 45 for reserving the game coins. With the pay completion signal generating circuit 38, there is connected a coin detect unit 46 for counting the number of game coins to be paid back for a prize from the reservoir hopper 45 to the coin payout tray 21. When the counted value of coins actually paid back reaches a predetermined bonus coin number data, a pay completion signal is transferred from the pay completion signal generating circuit 38 to the MPU 26.

With the display drive circuit 39, there are connected the effective line display lamps 11*a* to 11*e* and the credit number display 13, so that the display drive circuit 39 causes the display lamps 11*a* to 11*e* and the displays 13 and 14 to make displays in accordance with the instructions of the MPU 26.

With the speaker drive circuit 40, there is connected a speaker 47 for outputting sound effects through the speaker mouth 22. With the lamp drive circuit 41, there is connected back lamps 48 for illuminating the symbols, as appearing through the display windows 7, 8 and 9, from the back side.

Next, the operations of the present slot machine 1 to be controlled by the control unit 23 will be described with reference to the flow charts shown in FIGS. 8 to 15.

Figure 8:
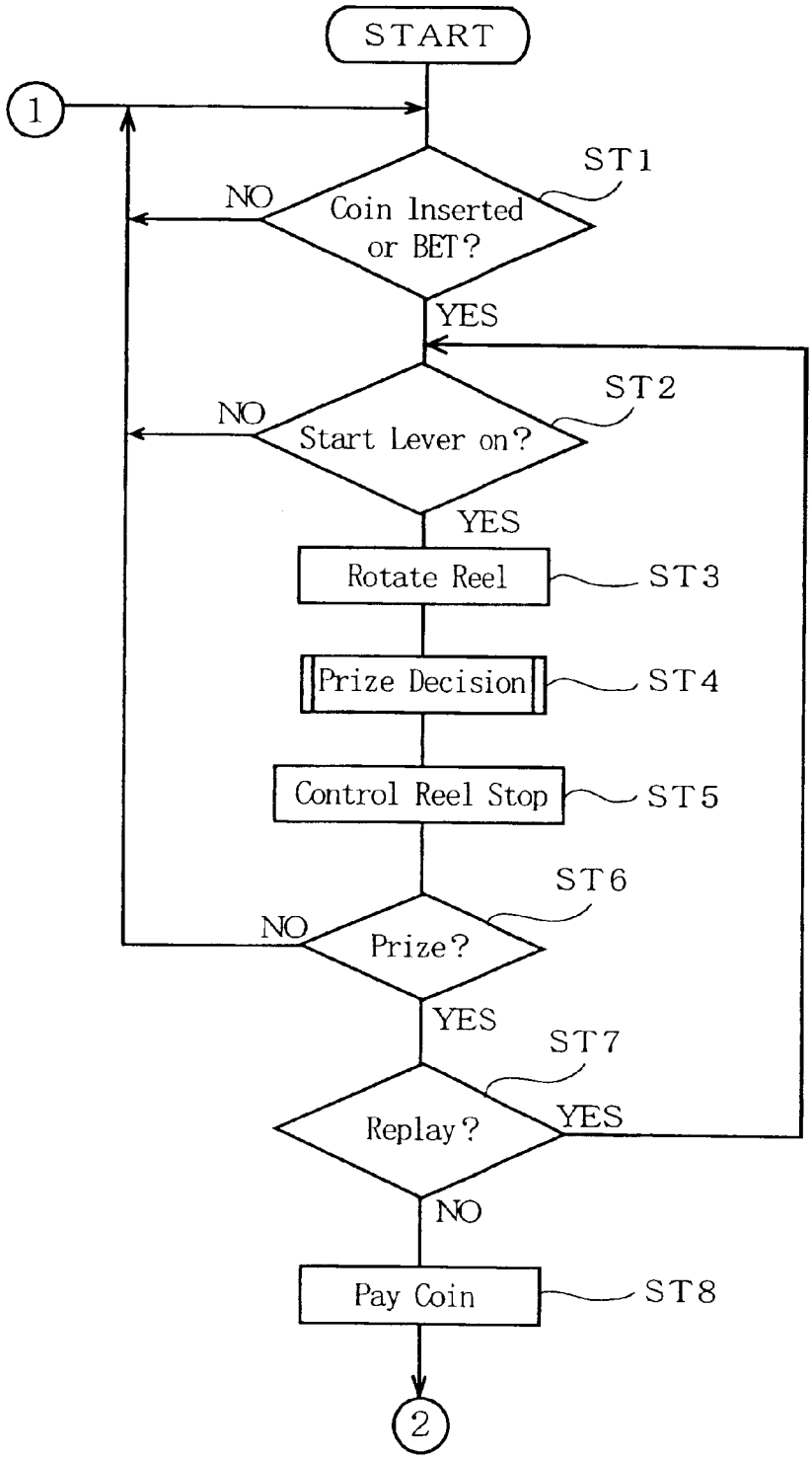
FIG. 8 is a flow chart showing the game processing routine of the control unit shown in FIG. 7.

In FIG. 8, the MPU 26 decides at first (or at step [as will be shortly referred to as the "ST"] 1) whether or not the coin BET has been made. This answer is "YES" when the coin was inserted into the slot 10 to make the detect signal input from the coin sensor 33 or when the signal input from the BET switch 12 was made. When "YES", it is then decided (at ST2) whether or not the game start lever 15 was operated. When this answer is "YES", the MPU 26 commands the motor drive circuit 34 to drive all the reels 4, 5 and 6 rotationally (at ST3). After this, a prize is decided (at ST4). This decision is made according to the later-described procedures of the flow charts of FIGS. 10 to 12.

Figure 10:
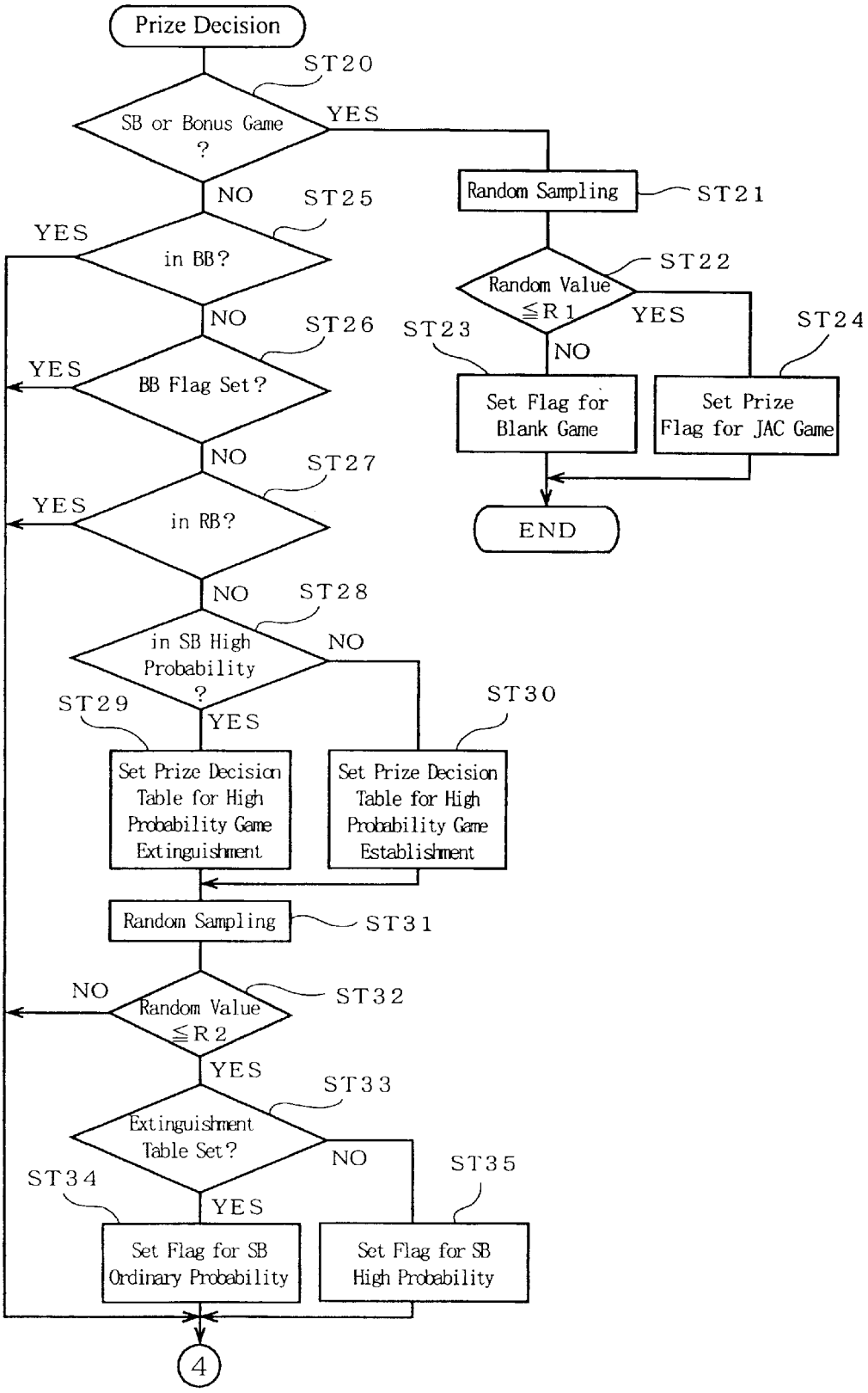
FIG. 10 is a flow chart showing a prize deciding routine by the control unit shown in FIG. 7.
Figure 12:
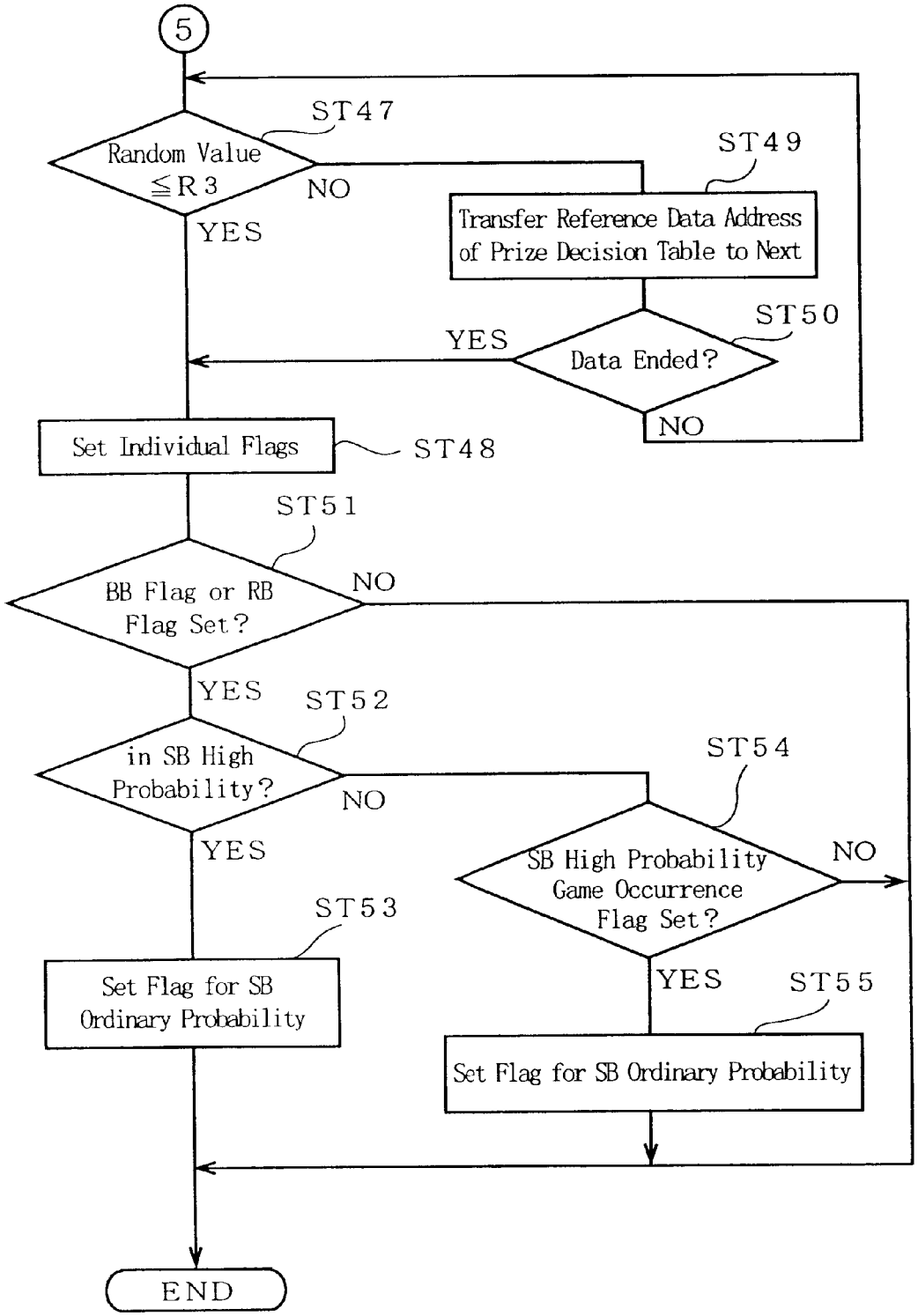
FIG. 12 is a flow chart further showing the prize deciding routine by the control unit shown in FIG. 7.

The prize flags to be set in this prize decision are one to be set at subsequent steps (i.e., ST34 and ST35), when the answer (of ST32) based on the random sampling of FIG. 10 is "YES", and the other to be set at subsequent steps (i.e., ST48, ST53 and ST55) when the answer (of ST47) based on the random sampling of FIG. 12 is "YES".

In accordance with the kind of the prize flag set as a result of the aforementioned prize decision, the reel stop is controlled (at ST5). It is then decided (at ST6) what prize mode the symbol combination at the reel stop belongs to. When this answer is "NO", the routine returns to ST1. When the answer is "YES", it is further decided (at ST7) whether or not the symbol combination at the reel stop time is the aforementioned "Replay" game. When this answer is "NO", a predetermined number of coins are paid back (at ST8), and the routine transfers to subsequent steps (of FIG. 9). When the answer is "YES", no coin is paid back, and the routine returns to the decision (of ST2) of the aforementioned operation of the start lever 15.

Figure 9:
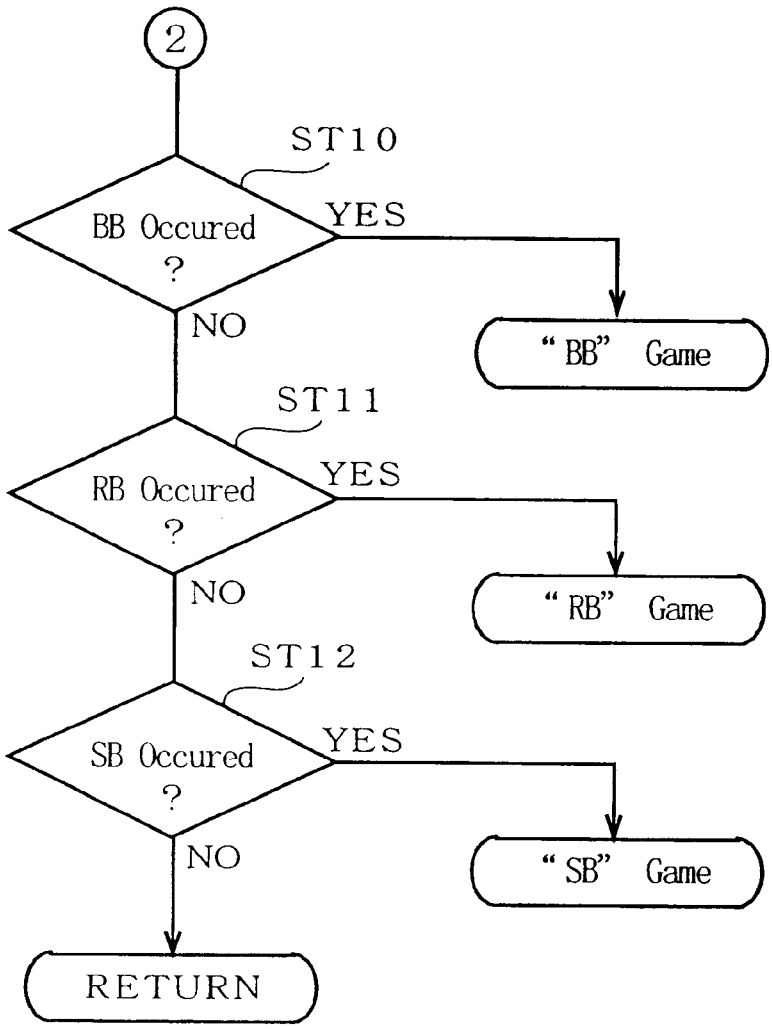
FIG. 9 is a flow chart further showing the game processing routine of the control unit shown in FIG. 7.

Next, as shown in FIG. 9, it is decided (at ST10) whether or not the prize pattern at the aforementioned reel stop time is the "BB game". When this answer is "YES", the routine advances to the flow chart of the "BB game" shown in FIG. 13. When the answer is "NO", it is then decided (at ST11) whether or not the prize pattern is the "RB game". When this answer is "YES", the routine advances to the flow chart of the "RB game" shown in FIG. 14. When not the "BB game" nor "RB game", it is decided (at ST12) whether or not the prize pattern is the "SB game". When this answer is "YES", the routine advances to the flow chart of the "SB game" shown in FIG. 15. When the answer is "NO", the routine returns to the first step (i.e., ST1) of all the operations shown in FIG. 8.

Next, the operation of the prize decision of step 4 of FIG. 8 will be described with reference to the flow charts of FIGS. 10 to 12. The random sampling to be used for this prize decision is performed by using the random number generator 31 and the random sampling circuit 32.

In FIG. 10, it is decided at first (at ST20) whether the present game is the "SB game" or a bonus game in the "RB game" or "BB game".

In the case of the bonus game, the random sampling is performed (at ST21), and it is decided (at ST22) whether or not the random number value is no more than a predetermined value $R_1$. Here, when the random number to be sampled is within a range of 0 to 16383 and if $R_1$=14744, the probability of random number$\leqq R_1$ is 14744/16384≈9/10, and the probability of random number >Ris (16384−14744)/16384≈1/10.

Next, when the aforementioned decision answer of the random number is "NO", the RAM 25 is set (at ST23) with the flag of a "Blank" game. When the answer is "YES", the RAM 25 is set (at ST24) with the flag of the "JAC" game (in which "JAC"-"JAC"-"JAC" are aligned on the center winning line L1), and the routine of the present flow is ended.

When the answer of the first ST20 is "NO" (that is, when not the bonus game), on the contrary, it is decided (at ST25) whether or not the present game is in the "BB game". When this answer is "YES", the routine transfers to the first step (i.e., ST36) of FIG. 11. When the answer is "NO", it is decided (at ST26) whether or not the BB flag has already been set. When this answer is "YES", the routine transfers to the first step (i.e., ST36) of FIG. 11. When the BB flag is not set, it is decided (at ST27) whether or not the game is in the RB. When this answer is "YES", the routine transfers to the first step (i.e., ST36) of FIG. 11.

When the BB flag and the RB flag are not set, it is then decided (at ST28) whether or not the existing game is in the "SB high probability game state" (or whether or not the SB high probability game state has been set before the present game). When in the "SB high probability game state", moreover, the prize decision table for extinguishing the "SB high probability game state" is set (at ST29). When not in the "SB high probability game state" (that is, when in the "SB ordinary probability game state"), the prize decision table for establishing the "SB high probability game state" is set (at ST30).

Here, the table for extinguishing the "SB high probability game state" has only one digit (e.g., 105) as the data to be compared with the random value sampled at next step 31, but the table for establishing the "SB high probability game state" is provided with a predetermined number (e.g., six) of data within a predetermined range (10 to 20). This is because a plurality of stages may be interchanged by operating the switches disposed in the control board box or in the system, for example, so that the payout ratio of the slot machine may be arbitrarily set on the side of the game house. Therefore, the data of the table, as compared with the random value sampled at the following step 31, for establishing the "SB high probability game state" are determined to one of the six data, for example, at the stage when the power source of the machine is turned ON.

Next at step 31, the random sampling is executed within a predetermined range (e.g., a range of 0 to 16383), and it is decided (at ST32) whether or not this sampled random value is no more than the predetermined value $R_2$ (e.g., 105 in the case of the table for the extinguishment, and one of 11 to 21 determined in advance by the switch operations in the case of the table for the establishment). The probability for the decision answer "YES" is 105/16384≈1/156, when the set table is for the extinguishment, and (11/16384)~(21/16384) ≈(1/1489)~(1/780), when the set table is for the establishment.

Figure 11:
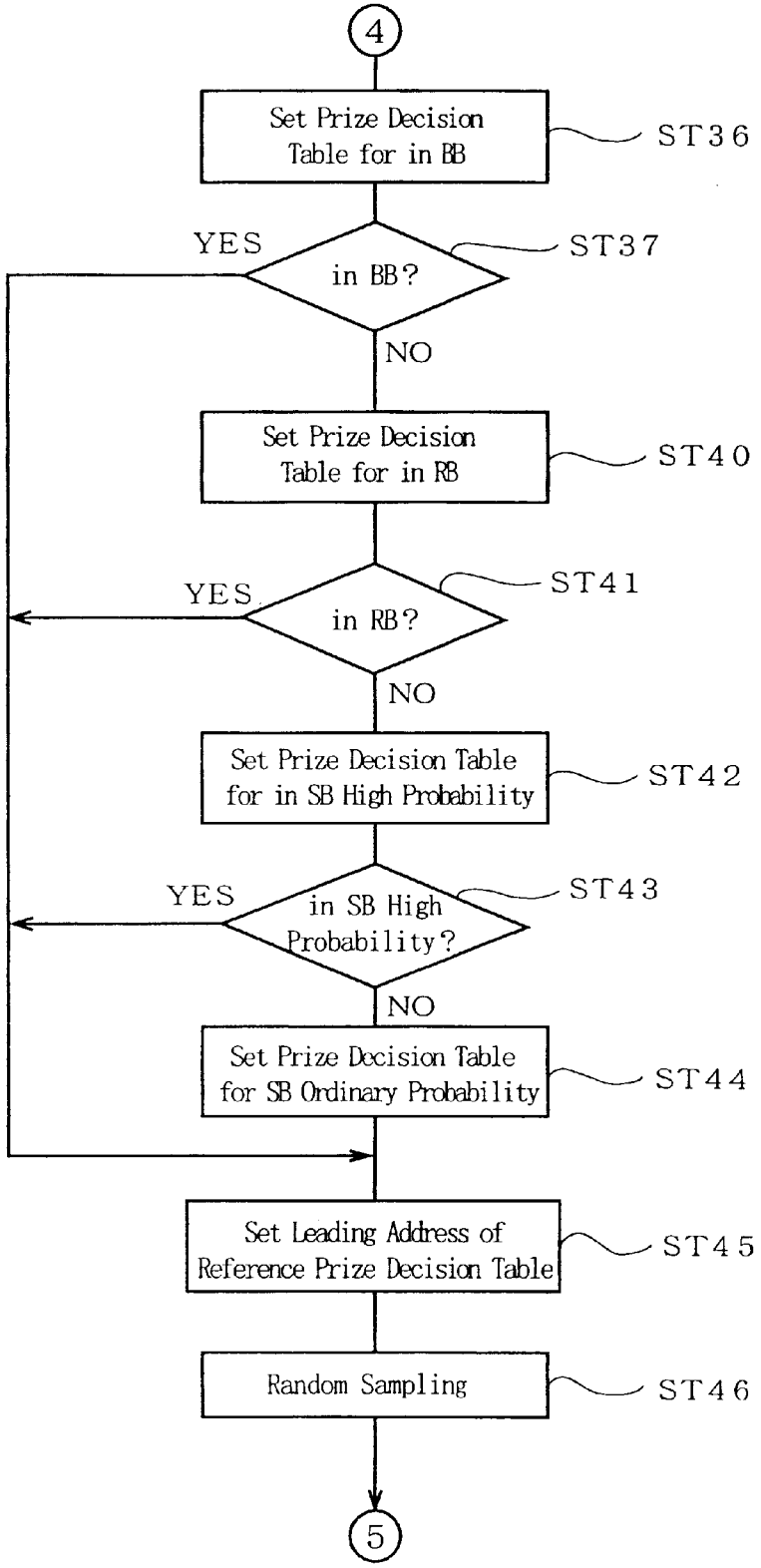
FIG. 11 is a flow chart further showing the prize deciding routine by the control unit shown in FIG. 7.

When the answer of the step 32 is "NO", the routine transfers to the first step of FIG. 11. When the answer is "YES", it is decided (at ST33) whether or not the set table is for the extinguishment. When this answer is "YES", the flag of the "SB ordinary probability game" is set (at ST34). When the set table is for the establishment, on the other hand, the flag of the "SB high probability game" is set (at ST35).

Next, the routine advances to the operations of FIG. 11. First of all, the prize decision table for "in the BB game" is set for the reference (at ST36), and it is decided (at ST37) whether or not the present game is in the BB game. When this answer is "YES", the routine transfers to the later-described step (i.e., ST45), at which the leading address of the data to be referred to at the prize decision table is set.

When the answer of ST37 is "NO", the prize decision table for "in the RB game" is set (at ST40). Next, it is decided (at ST41) whether or not the present game is in the RB game. When this answer is "YES", the routine transfers to the later-described ST45, at which the leading address of the data to be referred to in the prize decision table is set. When the present game is not in the RB game, on the contrary, the prize decision table for "in the SB high probability game", as shown in FIG. 6C, is set (at ST42).

It is then decided (at ST43) whether or not the present game is "in the SB high probability game". When this answer is "YES", the routine transfers to ST45, at which the leading address of the data to be referred to in the prize decision table is set. When not in the SB high probability game, on the contrary, the prize decision table for "in the SB high probability game" is reset, and the prize decision table for the "SB ordinary probability game" is set (at ST44).

Figures 15, 16:
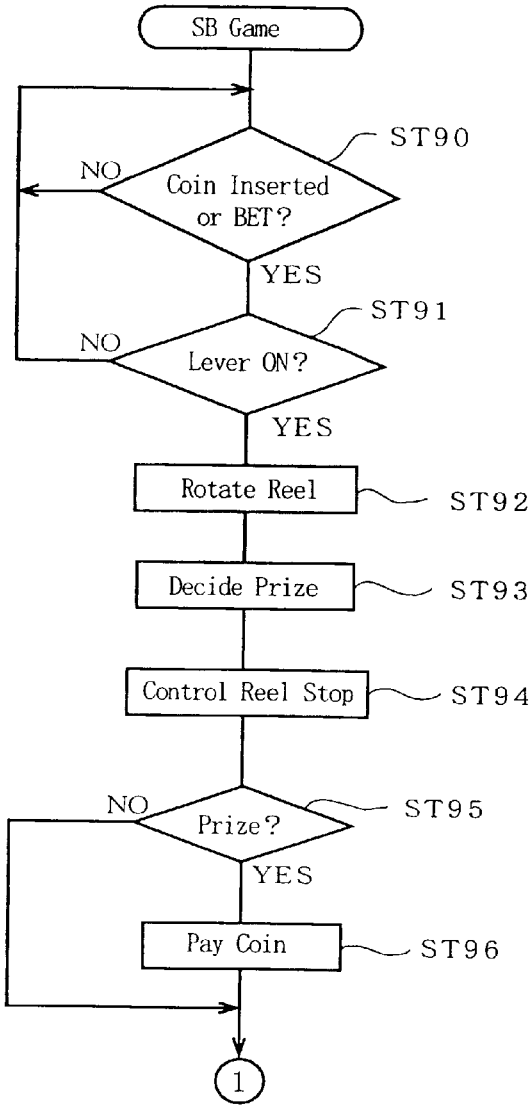
FIG. 15 is a flow chart showing an SB game processing routine by the control unit shown in FIG. 7.
FIG. 16 is a schematic diagram of a prize decision table.

The prize decision tables for the aforementioned "in the BB game", "in the RB game", "in the SB high probability game" and the "SB ordinary probability game" are individually provided with six data, as schematically shown in FIG. 16.

Each data is provided with the flags of prize modes and different numerical values as the data to be compared with the random value at the following step (i.e., at ST47). In FIG. 16, for example, the flags of prize modes (A), (B) and (C) are for the "BB game", "RB game" and "SB game", respectively, and the flag of prize mode (D) is for the "Replay" game.

At a next step (i.e., ST46), the random sampling is performed within the range of 0 to 16383, and it is decided (at ST47) whether or not the sampled random value is no more than $R_3$, as shown in FIG. 12. At this time, the sampled random value is compared with the leading data "(A)" of the prize decision table as the value $R_3$.

When the data (A) has a numerical value of 44 and when the sampled random value is 37, for example, this is smaller than $R_3$ so that the answer of ST47 is "YES". At the next step (i.e., ST48), the flag (i.e., "BB game") of the data is set (at ST48). Hence, the probability of setting this flag is 44/16384≈1/372.

When the answer of ST47 is "NO", the data (B) of the next address is set to $R_3$. So long as the data end is not decided at the next step (i.e., ST50), the routine returns to ST47, at which the sampled random value and the value R3 are compared. This operation is performed till the data end (e.g., six times in the table example of FIG. 16). When the answer of ST50 is "YES", the corresponding prize mode is absent so that the "Blank" flag is set at ST48.

Next, it is decided (at ST51) whether or not the "BB game" flag or the "RB game" flag is set. When this answer is "NO", the routine is ended. When the answer is "YES", it is then decided (at ST52) whether or not the "SB high probability game state" has prevailed before the start of the present game, that is, whether or not the "SB high probability game state" flag has been set before the game start. When this answer is also "YES", moreover, the routine is ended by resetting the "SB high probability game state" flag and by setting the "SB ordinary probability game".

When the answer of ST52 is "NO", on the contrary, it is decided (at ST54) whether or not the flag for generating the "SB high probability game state" has been set. When this answer is "YES", that is, when the prize decision of the present game has revealed that both the "BB game" flag or the "RB game" flag and the "SB high probability game state" flag are set, the routine is ended by resetting the "SB high probability game state" flag and by setting the "SB ordinary probability game state" flag (at ST55).

In case it is thus found by the prize decision that the "BB game" flag or the "RB game" flag is set, the "SB high probability game state" flag is reset not only when the "SB high probability game state" flag is set at the present prize decision but also when the "SB high probability game state" flag was set at and before the present game.

Figure 13:
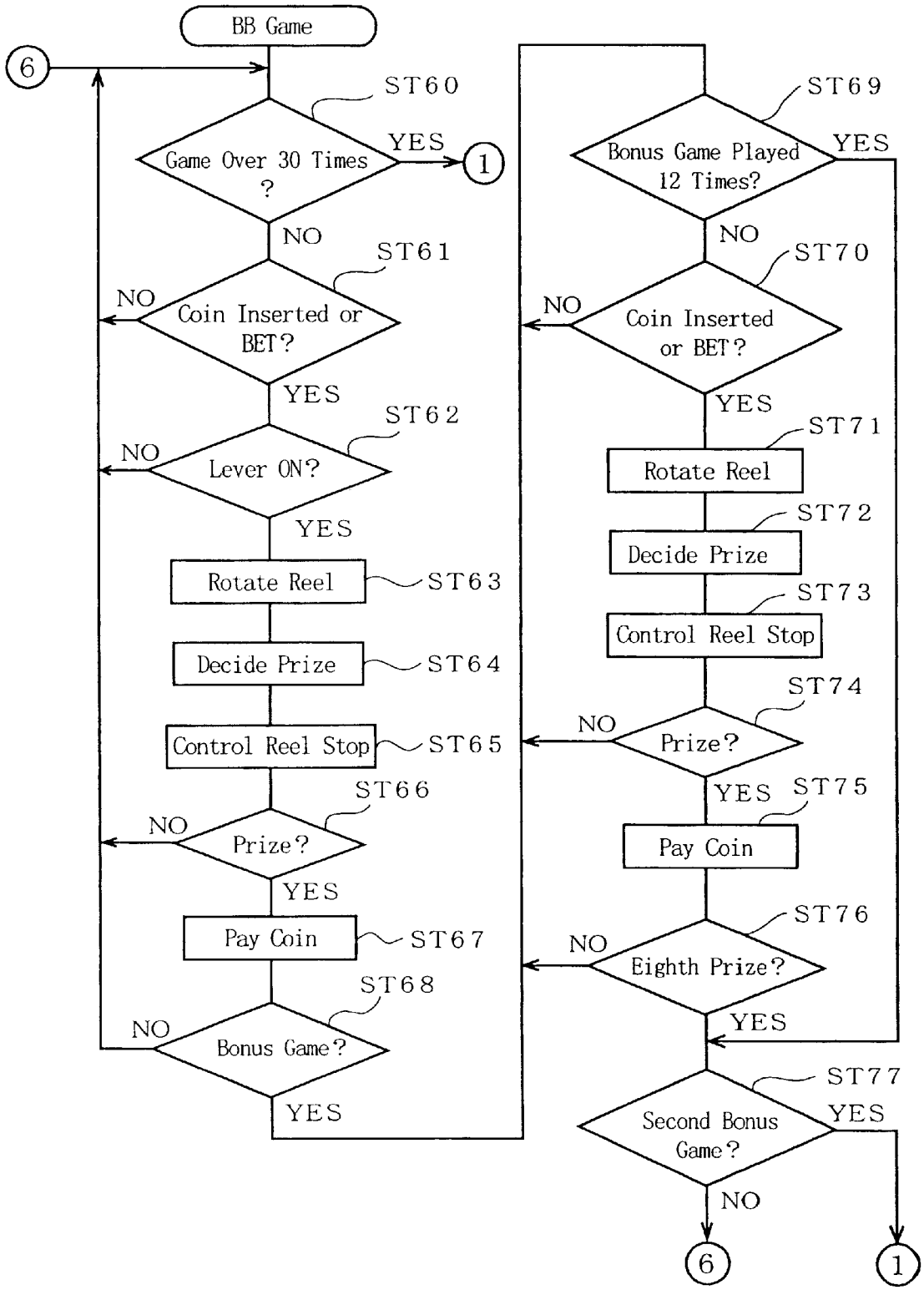
FIG. 13 is a flow chart showing a BB game processing routine by the control unit shown in FIG. 7.

Here will be described the operation procedure of the "BB game" with reference to FIG. 13.

First of all, it is decided (at ST60) whether or not the game number is over 30 times. When this answer is "YES", the routine returns to the first step (ST1) of all the operations, as shown in FIG. 8. When the game number is below 30 times, it is decided (at ST61) whether or not the coin BET has been made.

This answer is "YES" as at ST1 of FIG. 8, when the coin was inserted into the slot 10 so that the input from the coin sensor 33 is made or when the input from the BET switch 12 is made. In this case, it is then decided (at ST62) whether or not the game start lever 15 has been operated. When this answer is "YES", the MPU 26 feeds the motor drive circuit 34 with the drive signal to drive all the reels 4, 5 and 6 rotationally (at ST63).

After this, the prize is decided (at ST64). This decision corresponds to that of ST47 of FIG. 12 after the prize decision table for "in the BB game" was set at ST36 of FIG. 11, as described hereinbefore.

As a result of this prize decision, the stop of the reels 4 to 6 is controlled (at ST65) according to the kind of the set prize flag. It is then decided (at ST66) whether or not the display at the reel stop time is a predetermined prize pattern. When this answer is "NO", the routine returns to ST60. When the answer is "YES", a predetermined number of coins are paid back (at ST67), and the routine transfers to ST68.

At ST68, it is decided whether or not the game is the bonus game. When this answer is "NO", the routine returns to ST60. When the answer is "YES", it is decided (at ST69) whether or not the bonus game has been played twelve times. When this answer is "YES", the routine transfers to the later-described ST77, at which it is decided whether or not the bonus game is a second set. When this answer is "YES" (that is, when the bonus game is played at the second set), the routine returns to the first step (i.e., ST1) of all the operations shown in FIG. 8. When the answer is "NO", the routine returns to ST60.

When it is decided at ST69 that the bonus game is not played twelve times, on the contrary, it is decided (at ST70) like before whether or not the coin BET has been made. When this answer is "NO", the routine returns to ST69. When the answer is "YES", all the reels 4, 5 and 6 are rotationally driven (at ST71). After this, the prize is decided (at ST72). This decision corresponds to that of ST22 of FIG. 10.

As a result of this prize decision, the stop of the reels 4, 5 and 6 is controlled (at ST73) according to the kind of the set prize flag. It is then decided (at ST74) whether or not the symbol combination at the stop time of the reels 4 to 6 corresponds to any of the prize modes. When the answer is "NO", the routine returns to ST69.

Next, a predetermined number of coins are paid back (at ST75), and it is then decided (at ST76) whether or not the prize is the eighth. When this answer is "NO", the routine returns to ST69. When the answer is "YES", it is decided (at ST77) whether or not the bonus game is at the second set. When this answer is "NO", the routine returns to ST60. When the answer is "YES", the routine returns to the fist step (i.e., ST1) of all the operations shown in FIG. 8.

Figure 14:
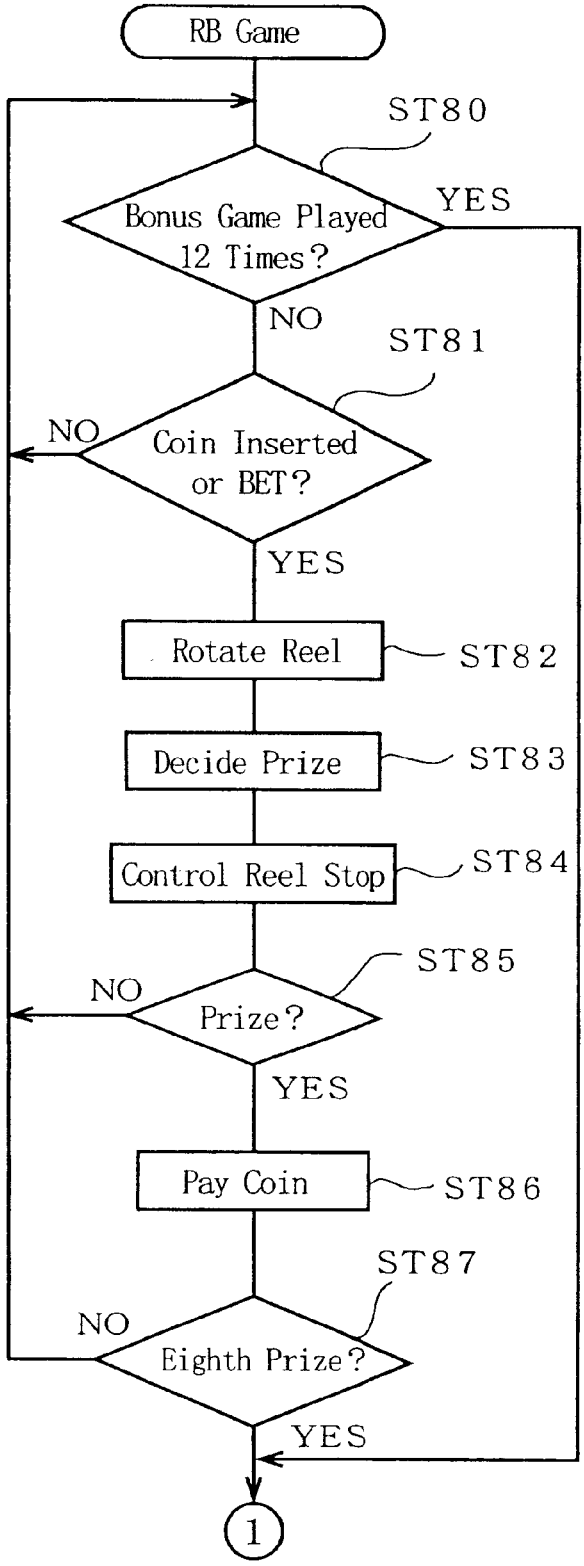
FIG. 14 is a flow chart showing an RB game processing routine by the control unit shown in FIG. 7.

Here will be described the operation procedures of the "RB game" with reference to FIG. 14.

It is decided (at ST80) whether or not the bonus game in the "RB game" has been played twelve times. When this answer is "YES", the routine returns to the first step (i.e., ST1) of all the operations shown in FIG. 8. When the answer is "NO", it is decided (at ST81) whether or not the coin BET has been made. When this answer is "NO", the routine returns to ST80. When the answer is "YES", all the reels 4, 5 and 6 are rotationally driven (at ST82). After this, the prize is decided (at ST83). This corresponds to the decision of ST22 of FIG. 10.

As a result of this prize decision, the stop of the reels 4 to 6 is controlled (at ST84) according to the kind of the set prize flag. It is then decided (at ST85) whether or not the display at the stop time of the reels 4 to 6 is a predetermined prize pattern. When this answer is "NO", the routine returns to ST80. When the answer is "YES", a predetermined number of coins are paid back (at ST86). After this, it is decided (at ST87) whether or not the prize number is the eighth. When this answer is "NO", the routine returns to ST80. When the answer is "YES", the routine returns to the first step (i.e., ST1) of all the operations shown in FIG. 8.

Here will be described the operation procedure of the "SB game" with reference to FIG. 15.

First of all, it is decided (at ST90) like before whether or not the coin BET has been made. When this answer is "NO", a standby is made as it is. When the answer is "YES", it is decided (at ST91) whether or not the game start has been instructed by the operation of the game start lever 15. When this answer is "YES", all the reels 4, 5 and 6 are rotationally driven (at ST92). After this, the prize is decided (at ST93). This corresponds to the decision of ST22 of FIG. 10.

As a result of this prize decision, the stop of the reels 4 to 6 is controlled (at ST94) according to the kind of the set prize flag. It is then decided (at ST95) whether or not the display at the stop time of the reels 4 to 6 is a predetermined prize pattern. When this answer is "NO", the routine returns to the first step (i.e., ST1) of all the operations shown in FIG. 8. When the answer is "YES", a predetermined number of coins are then paid back (at ST96), and the routine returns to the first step (i.e., ST1) of all the operations shown in FIG. 8.

As has been described hereinbefore, according to the slot machine 1 of this embodiment, by adjusting not only the number of lottery random numbers of a specific mode (e.g., the SB game) in the prize decision table to be applied in the ordinary probability game state and in the prize decision table to be applied in the high probability game state but also the number of lottery random numbers for another mode (e.g., the Bell), the total $R_T$ of the expected values in the individual prize decision tables is set to the proper expected value Rmax or less. This can avoid in advance the problem that the so-called "payout ratio" becomes excessively high. As a result, a proper game mode can be provided for the player and a game machine which will impose no economical burden can be realized for the game house.

Here, this embodiment has been described on the case in which the total $R_T$ of the expected values of the prize decision table to be applied in the high probability game state is adjusted to the proper expected value Rmax or less by adjusting only the number of lottery random numbers for another mode "Bell". By adjusting the number of lottery random numbers for one another mode such as the "Replay" or "Bullet" or the number of lottery random numbers for a plurality of modes, however, the total $R_T$ of the expected values of the prize decision table may be adjusted to the proper expected value Rmax or less.

Although the present invention has been explained in reference to the embodiments, it is apparent for those skilled in the art that many changes and modifications can be made without departing from the spirit and scope of the invention, as clear from the following claims.

What is claimed is:

1. A game machine having an ordinary game state in which a plurality of prize modes occur and a high probability game state in which said plurality of prize modes occur and a prize probability of a predetermined one of said plurality of prize modes is enhanced, and adapted to be transferred, when a predetermined condition is satisfied, from said ordinary game state to said high probability game state, wherein a prize probability of at least one prize mode other than said predetermined prize mode among said predetermined prize modes which occur in said high probability game state is set lower than a prize probability of said at least one prize mode which occur in said ordinary game state.

2. A game machine according to claim 1, wherein said plurality of prize modes are lotted by a random sampling so that the prize probability of a predetermined prize mode in said high probability game state is enhanced by increasing the number of the lottery random numbers for said predetermined prize mode whereas the prize probability of said one other than said predetermined prize mode in the high probability game state is lessened by reducing the number of the lottery random numbers for said one other than said predetermined prize mode.

3. A game machine according to claim 2, wherein the prize probabilities of a plurality of said ones other than said predetermined prize mode in the high probability game state are lessened by reducing the numbers of the lottery random numbers for said ones other than said predetermined prize mode.

4. A game machine according to claim 2, wherein prize decision tables to be used at the time of a prize decision in a game routine are prepared for said ordinary probability game state and for said high probability game state, wherein the number of the lottery random numbers for said predetermined prize mode, as stored in the prize decision table for said high probability game state, is made larger than the number of the lottery random numbers for said predetermined prize mode, as stored in the prize decision table for said ordinary probability game state, and wherein the number of the lottery random numbers for said one other than said predetermined prize mode, as stored in the prize decision table for said high probability game state, is made smaller than the number of the lottery random numbers for said one other than said predetermined prize mode, as stored in the prize decision table for said ordinary probability game state.

5. A game machine according to claim 4, wherein the total of expected values for the individual prize modes, as indicating numerical values of how much payout of game medium to be bet for a game can be expected at the unit of the game medium, is set at a higher value in said high probability game state than in said ordinary probability game state.

6. A game machine according to claim 5, wherein a expected value of said expected values for said predetermined prize mode is set at a higher value in said high probability game state than that in said ordinary probability game state whereas a expected value of said expected values for said one other than said predetermined prize mode is set at a lower value in said high probability game state than that in said ordinary probability game state, so that said total of the expected values for the prize decision table in said high probability game state is set at a desired proper value.

7. A game machine according to claim 6, wherein said total of the expected values for the prize decision table in said high probability game state is set at the desired proper value by adjusting the individual expected values of a plurality of said ones other than said predetermined prize mode.

8. A game machine according to claim 2, wherein said predetermined prize mode is a high bonus mode whereas said one other than said predetermined prize mode is a low bonus mode.

9. A game machine according to claim 3, wherein said predetermined prize mode is a high bonus mode whereas a plurality of said ones other than said predetermined prize mode are low bonus modes.

10. A game machine according to claim 8 or claim 9, wherein said predetermined prize mode is a single bonus game.

* * * * *